US010352658B1

(12) United States Patent
Aslin et al.

(10) Patent No.: US 10,352,658 B1
(45) Date of Patent: Jul. 16, 2019

(54) RIFLE SCOPE AND MOUNT SYSTEM

(71) Applicants: James David Aslin, North Bend, OR (US); Larry J Crapo, Woodburn, OR (US)

(72) Inventors: James David Aslin, North Bend, OR (US); Larry J Crapo, Woodburn, OR (US)

( * ) Notice: Subject to any disclaimer, the term of this patent is extended or adjusted under 35 U.S.C. 154(b) by 0 days.

(21) Appl. No.: 16/043,030

(22) Filed: Jul. 23, 2018

Related U.S. Application Data

(60) Provisional application No. 62/669,512, filed on May 10, 2018.

(51) Int. Cl.
*F41G 11/00* (2006.01)

(52) U.S. Cl.
CPC ..... *F41G 11/003* (2013.01); *F41G 11/001* (2013.01)

(58) Field of Classification Search
CPC ..... F41G 11/001–11/003
See application file for complete search history.

(56) References Cited

U.S. PATENT DOCUMENTS 870,273 A * 11/1907 Burton ..... F41G 11/003 42/125
2,715,275 A * 8/1955 Kipp ..... F41G 11/003 42/126
4,255,013 A * 3/1981 Allen ..... F41G 1/38 356/247
5,035,487 A 7/1991 Herz
6,123,363 A * 9/2000 Burgard ..... E21B 17/0426 285/24
6,295,754 B1 * 10/2001 Otteman ..... F41G 1/38 42/111
2008/0022576 A1 * 1/2008 Epling ..... F41G 1/38 42/124
2010/0024276 A1 * 2/2010 Kellis ..... F41G 11/001 42/124
2018/0195835 A1 * 7/2018 Crispin ..... F41G 1/30

* cited by examiner

*Primary Examiner* — Charlie Y Peng

(57) ABSTRACT

A scope and mount block assembly for a rifle includes a scope having sets of spaced apart ribs for seating into complementary arcuate grooves in scope mount components. An underside keyseat in the scope aligns with a complementary keyseat in a scope mount block, and a key residing in the combined volume of both keyseat enforces this alignment. The scope mount blocks clamp to any standard rail such as a Picatinny rail. When the scope is removed, leaving the blocks in place, it can be reattached so that the key reestablishes its alignment to the rifle and no re-sighting of the scope is required. Also, careful selection of pitches for the scope ribs and for spaced apart features for engagement of the mount blocks to a mounting rail can offer much finer incremental location of the scope on the rifle for more precise adjustment of eye relief.

11 Claims, 7 Drawing Sheets

RIFLE SCOPE AND MOUNT SYSTEM

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS-REFERENCE TO THE RELATED APPLICATION

This application claims the benefit of priority to U.S. provisional patent application 62/669,512 "Rifle Scope and Mount Assembly" filed May 10, 2018. The entire content of U.S. provisional patent application 62/669,512 "Rifle Scope and Mount Assembly" filed May 10, 2018, is hereby incorporated into this document by reference.

FIELD

The invention relates to a rifle scope and means for securely attaching it to a rifle.

BACKGROUND

Rifle scopes, also called telescopic sights, were first invented and affixed to long barrel firearms around the late 1830s. Since that time, longarms have improved in manufacturing quality, shooting accuracy, effective range, and hitting power. Recoil force and impulse have also increased not only in military arms but with civilian arms as well.

Firearms, both rifles and pistols, compressed-gas guns, spring-powered rifles and pistols, and others, have been enhanced by optical telescopic sights mounted to the weapon by attachment systems employing split-clamping rings. Such rings historically have clamped around the tubular sections of such telescopes and provide various adapting-clamping systems as part of the ring to complete the attachment of the telescope to the firearm itself.

A recurring problem of the split-clamping ring portion of the mounting is the shifting of the telescope within the clamping ring due to the forces of inertia. Such forces are generated by the recoil of the firearm's discharge, or moving, jarring effects of the various mechanical movements of bolts, slides, heavy springs, etc. If the telescope shifts, the impact point on the target may also shift, degrading the precision and accuracy of the firearm which opposes the purpose of mounting the telescope which is the precision and reliability of projectile placement.

The clamping action of most split-ring type mounts uses friction generated by the clamping force applied by the ring to the smooth, cylindrical telescope body tube. Various approaches have been applied to prevent the shifting of the telescope in the clamping rings, including (a) glue or plastic fillers applied between scope and rings, (b) friction enhancers such as fine sand paper inserts, but mainly (c) the use of larger split-ring clamps able to apply greater clamping forces to keep the scope tube from inertial-dynamic shifting in the rings. These methods have been largely successful at reducing or preventing scope shift in firearms chambered to traditional calibers in service from decades ago to the present time.

However, as interest in extreme long distance and precision shooting increases, modern telescopes are being produced with higher magnifications, which are of larger diameter to let in more light, and are correspondingly more massive. Long range firearms such as those chambered in .338 Lapua, .50BMG and even 20 mm generate much greater recoil than traditional cartridges, and the inertia of a heavier scope subjected to a heavier recoil impulse demand more positive anti-slipping means of attaching a telescopic sight to a rifle.

Another problem encountered by users of firearm mounted telescopic sights encounter is the alignment of the telescope with the firearm's bore: at the time when a scope is mounted the rotational alignment of the scope about the scope's longitudinal axis is established, and once the scope is zeroed-in it is desirable that this alignment not be perturbed.

Although uncommon, some rifles are designed with sighting means that may be both vertically and horizontally offset from the shooting axis of the weapon. However for the vast majority of rifles the reticle in the scope's sight picture should normally be adjusted so when the viewer holds the horizontal reticle level and the vertical reticle perpendicular to level, the centerline of the bore of the firearm should be directly vertically below the intersection of the horizontal and vertical reticles in the scope's sight picture. If this condition is not met the projectile will probably not impact where intended. With traditional friction-type split-ring clamps, this desired alignment can be lost when tightening the clamping screws when installing the scope.

Traveling with scoped firearms presents additional challenges because many components inside the scope are delicate and rely on exceedingly precise adjustments and alignments of small and fine parts. Like other parcels, rifles shipped by common carriers or aboard commercial passenger planes, buses, vessels, or trains are subjected to dropping, kicking, accidental shocks, and sometimes even willful abuse. Despite presenting a more awkward aspect ratio than most other luggage, the barrel, receiver, and stock of firearm secured in a case are generally much more robust than the delicate scope, have a better chance of surviving the transit or shipping undamaged and unscathed. Thus for people traveling with their scoped rifles, there is an interest in being able to detach a scope from the rifle so as to carry it under their own watchful eyes and gentle care.

Besides horizontal and vertical alignment and the demands of secure attachment of a scope to a rifle, a shooter needs to be able to fix the scope onto the rifle at an appropriate distance ahead of where the shooter's head rests when looking through the scope to aim the rifle at a target. Since this ideal distance may sometimes be less than an inch or only a few inches, a gun having heavy recoil can be thrust backward and the rear rim of the scope can strike the shooter in the forehead and even lacerate the skin above the eye pinched between the scope rim and the shooter's skull. The consequence of "scope bite," as this is called, can range from a minor blunt force inconvenience to a substantial injury including bleeding.

BRIEF SUMMARY OF THE INVENTION

A primary objective of the invention is to provide a means of securely attaching a telescopic sight (i.e, a scope) to a firearm such that typical impacts, transit shocks, and the recoil from firing the weapon do not perturb the precise alignment relationship between the axis defined by the bore of the weapon and the precisely adjusted optical components inside the telescopic sight. Even the slightest incremental movement of the scope, either by axial slippage or angular rotation, while in its clamped state should be eliminated entirely.

Another objective of the invention is to allow a person installing a scope to set it at an appropriate position on the gun, ahead of a place on the rifle where shooter's head rests while aiming. A corollary objective is to be able to mount the scope at a number of axially displaced positions substantially parallel to the shooting axis of the weapon.

Another corollary objective of the invention is to provide a built-in alignment system to at least grossly align the sighting axis of the scope with an axis defined by its mount blocks, even though it is positioned at any of said axially displaced positions substantially parallel to the shooting axis of the weapon.

Yet another corollary objective of the invention is to provide a built-in alignment system to positively and repeatably establish the angular orientation of the scope in its sighting axis when initially installed, or if it is removed and replaced, including if it is relocated from one axial position to another axial position within the mount system.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1:
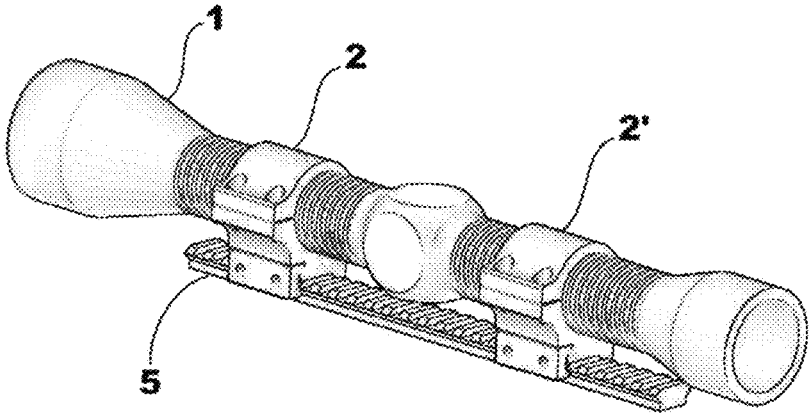
FIG. 1 shows an assembled scope and mount block assembly in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the verb to "zero," to "zero-in, or to "sight in" a scope or a gun equipped with a scope means the act of making adjustments to the internal sighting components and the reticle within a scope affixed to a rifle, so that a bullet discharged by the gun while the sight picture is aligned with a target point of a known distance will, notwithstanding perturbations in flight, strike at or near that predetermined target point within an acceptable deviation. Once a gun is sighted in, at a given range, calculations and compensations can be made which enable similarly accurate shooting at targets of different distances and elevation, and further compensations can be calculated for cross winds, air temperature, and density, and for long distances even the Coriolis effect can be calculated to compensate for the rotation of the earth while the bullet is in flight.

This specification is written in accordance with 20th century American Standard English grammar. In cases of words or pronouns having grammatical gender, which may or may not be related to biological sex, the masculine grammatical gender subsumes the feminine grammatical gender. Thus the pronouns "he," "his," and "him" may be interpreted to stand for "she," "her," "hers" and "her." Plural forms "we," "they," and "them" shall always be taken to refer to pluralities of persons. A "user" or a "shooter" may be a person of any gender or sex. The words "rifle," "firearm," and "gun" are used interchangeably in this specification. Also, this specification assumes US customary units for all quantities of measurement unless otherwise specified.

The invention is a scope and mount block assembly for a rifle, which includes a scope having one or more pluralities of transverse, spaced apart ribs and grooves cut into one or more of its tubular sections which seat into complementary accurate grooves in scope mount components.

Each scope mount, of which two are most commonly provided, comprises a mount block, a clamp member, and a rail clamp. An underside keyseat in the scope is a first keyseat which aligns with a second keyseat in a scope mount block, and a key residing in the combined volume of both keyseats enforces this alignment. The scope mount blocks include means for clamping to a mounting rail, such as means adapted for engagement with a Picatinny mounting rail.

When the scope is removed while leaving the blocks in place, it can be reattached so that the key reestablishes its alignment to the rifle and, theoretically no re-sighting of the scope would be required.

Referring now to the figures, FIG. 1 shows an assembled scope and mount block assembly in accordance with the invention. A typical scope has flared ends for magnifying lenses and other optics, and at least one tubular section defining a longitudinal axis of the device.

The scope [1] is attached to a standard rail [5] which may be a MIL-STD-1913 Picatinny rail or any other sort of standard accessories rail. Two scope mounts [2, 2'] are clamped to the rail and receive the scope. Each scope mount comprises three components and threaded fasteners.

Figure 2:
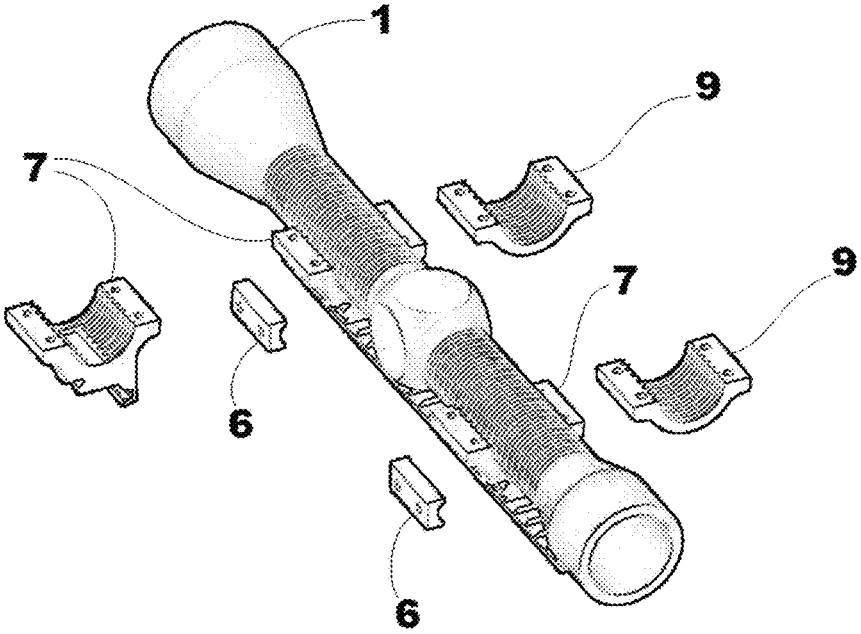
FIG. 2 shows the scope and mount block assembly of FIG. 1 with some components removed and displaced.

FIG. 2 shows the scope and mount block assembly of FIG. 1 with some components removed and displaced. The scope [1] preferably has at least two sets of mounts. Each mount comprises a mount block [7,] a scope clamp member [9,] and a rail clamp [6.] A mount block or a clamp member or both may further comprise a plurality of complementary grooves for receiving and engaging with transverse ribs the scope.

The rail clamp and a downward-projecting flange on the bottom of the mount block each have V-grooves adapted to grip an accessories rail affixed to a rifle.

Figure 3:
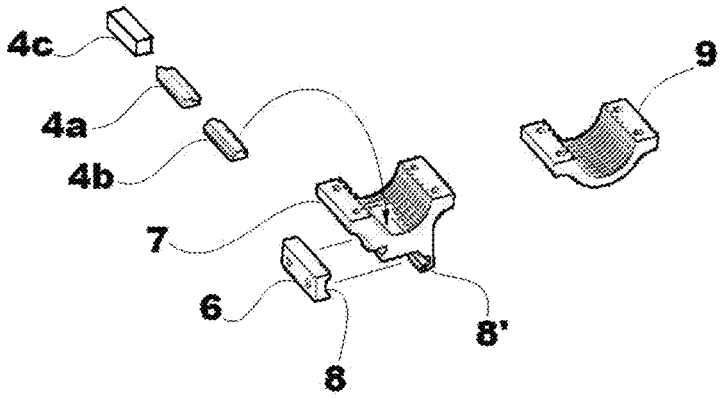
FIG. 3 shows components of a scope mount in accordance with the invention.

FIG. 3 shows components of a scope mount in accordance with the invention. At least one mount block [7] includes a keyseat adapted to accept a custom key [4*a*, 4*b*] or a square key [4*c*] of any effective design or cross section. The V-grooves [8, 8'] in the rail clamp [6] and the downward-projecting flange on the bottom of the mount block [7] are seen to face each other for clamping onto an accessories rail affixed to a rifle. Grooves in both the mount block and the rail clamp have ribs which are complementary to sets of ribs on the scope. When fasteners (which are usually threaded fasteners) draw the grooved surfaces of the mount block and clamp member together, a centralizing average of the actual individual centers of all surfaces of rotation of all grooves is established. Effective centralizing can occur with a set comprising as few as four grooves mated to four complementary ribs on a scope, and as the number of grooves is increased beyond four, ever greater precision in locational tolerances is achieved. Disassembly and reassembly of the ribbed scope into the grooved components of the scope mounts and clamp members relocates the scope to very nearly the same original position with respect to the scope mounts, so as long as the mounts themselves have not shifted with respect to the rail, the relationship between the scope's sighting axis and the axis of the rifle barrel will be reestablished to sufficient accuracy that the remounted scope will be as well zeroed on the rifle as it was before dismount. The rifle will be ready for use without further time and ammunition expenses. In this specification, the word 'keyseat' also encompasses similar terms such as 'keyslot' and 'keyway.'

Figure 4A:
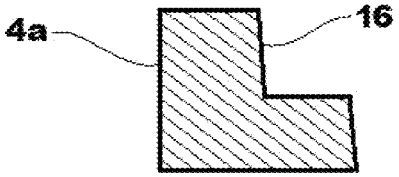
FIG. 4*a* shows a cross section of a key for a scope and mount block assembly in accordance with the invention.

A variety of profiles can be used for an alignment key in accordance with the invention. FIG. 4*a* shows a cross section of a key [4*a*] for a scope and mount block assembly in accordance with the invention. This section is built from a rectangle or slightly tapering trapezoid, with a rabbet cut into one side. The rabbet surface [16] may face either way, and it may also have a draft angle.

Figure 4B:
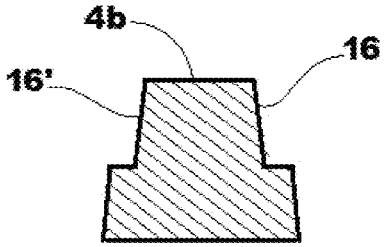
FIG. 4*b* shows a cross section of an alternate embodiment of a key for a scope and mount block assembly in accordance with the invention.

FIG. 4*b* shows a cross section of an alternate embodiment of a key [4*b*] for a scope and mount block assembly in accordance with the invention. This section is also built from a rectangle or slightly tapering trapezoid, but with a rabbet cut into each side [16, 16'.] The rabbets may also have a draft angle.

Figure 4C:
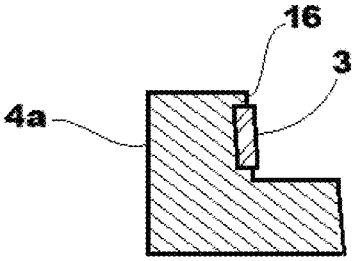
FIG. 4*c* shows a cross section of another alternate embodiment of a key for a scope and mount block assembly in accordance with the invention.

FIG. 4*c* shows a cross section of another alternate embodiment of a key [4*a*] for a scope and mount block assembly in accordance with the invention. This key has a rabbet surface [16] which further comprises a channel cut into which a firm yet compressible material [3] is inserted. Optionally, the side face of the key below the rabbet cut may also include another channel with another insert [3' in FIG. 4*d*] made of compressible material. For all compressible inserts of the key shapes described, any elastomeric material having a Shore A durometer of at least 50 Shore A is contemplated within the scope of the invention. For most sporting use scope and mount assemblies in accordance with the invention, a rubber material like Viton®, a fluoroelastomer commonly used in o-rings, can serve the purpose. Other, firmer materials such as vulcanized rubber can also work.

Figure 4D:
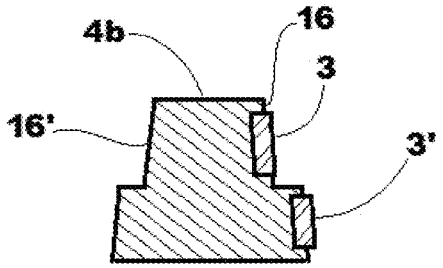
FIG. 4*d* shows a cross section of yet another alternate embodiment of a key for a scope and mount block assembly in accordance with the invention.

FIG. 4*d* shows a cross section of yet another alternate embodiment of a key [4*b*] for a scope and mount block assembly in accordance with the invention. This section is also built from a rectangle or slightly tapering trapezoid, but with a rabbet cut into each side [16, 16'.] These rabbets may also have a draft angle. One rabbet surface may further comprise a channel cut into which a firm but compressible material [3] is inserted. Optionally, the side face of the key below the rabbet cut may also include another channel with another insert [3'] made of compressible material.

For FIGS. 4*c* and 4*d*, the purpose of the elastomeric insert is to create an interference fit between the key and the keyseats of the mount block and the underside of the ribbed scope. For a keyseat having a slight clearance fit to admit a key, it is possible to cut the keyseat to a manufacturing tolerance so that the key can supposedly center itself so that the midplane of its seated width in a keyseat will nearly coincide with a center plane symmetry of the keyseat. The locational error between the midplanes of the key and keyseat could be up to one-half of the difference of the width of the keyseat minus the width of the key. For example, a key having a seated width of 0.250 in deposited within a keyseat with a width of 0.253 in will reside up to 0.0015 in displaced from the center plane defined by the keyway.

When aligning a scope to a rifle, if for example two mounts are placed 4 inches apart, if one were re-seated perfectly and the other were displaced from its original seating by the 0.0015 in referenced above, the misalignment would be almost 1.29 minutes of arc compared to the alignment before disassembly. This angular error when extended out to 1000 yards translates to a target error of about 13.5 inches. In context, long-distance competition shooting commonly takes place at ranges of 1000 yards and sometimes up to and even exceeding one mile. Competitive accuracies at these extreme ranges are about one-quarter of one minute of arc. Thus, many commonly acceptable machining tolerances are unserviceable for participants in this sport and much more precise re-assembly tolerances must be found, such as can be provided by the invention.

Fortunately, keyseats and especially tapered keyseats, can have a machined accuracy of fit that can be much closer than 0.003 inch, or can have an interference fit eliminating clearance altogether. When tolerances are loose, the positional error in assembly introduced within the interfaces of the scope, keys, keyseats, and mounts produce not a radial displacement on the horizontal or vertical plane, but only a rotational displacement about the longitudinal axis. This possible displacement of this example would only affect the tilt of crosshairs seen inside the scope from a theoretically level horizontal reference as defined by other features of the weapon. In such an example, 0.003 inches of looseness or error for a scope tube of a radius of 16 mm (for a scope tube of 32 mm diameter) would produce only about 0.27 degrees of angular displacement of the reticle components with respect to the rest of the weapon.

Continuing this example, a typical 175 grain .308 NATO round has a high ballistic coefficient (i.e, lower drag through the air than other bullet shapes of that caliber,) and will drop about 246 inches at 1000 yards. The tangent of the 0.003 inch rotational variation of such a scope and ring assembly, divided by the 16 mm radius of the scope is 0.0048. Extrapolating this angular error out to 1000 yards yields only 1.17 inches of additional positional uncertainty. Thus the 0.003 inch machining tolerance contributes less than 0.12 minutes of arc of horizontal variation and essentially no vertical variation. The horizontal and vertical alignment of the ribbed scope in the matching grooved rings and bases ensure a solid, clamped, interference fit that allows repeatable and rigid assembly and should eliminate all variation in horizontal or vertical radial directions.

Besides an elastomeric insert, if needed, other flexible, compressible means can be used as biasing means to establish and bias all re-mateable datums to one side of a keyway. For example a leaf spring can be deposited in the channel cut into the rabbet surface, or the key may further comprise one or more cantilever beams whose ends interfere with the width of the keyway. Seating the key in the keyway flexes the beam or beams, and the restoring force retained in the beam pushes the opposite face of the key to abut the opposite sidewall of the mount block keyway.

With the key so biased to one side of the mount block keyway, the ribbed scope is seated the mount block with its ribs meshing into the grooves of the mount block. The scope is then turned so that either sidewall of the keyway cut into the underside of the scope abuts a surface of the key. The clamp members can then be secured to the mount blocks. During re-assembly, as long as the user relies upon the same alignment surfaces used in the previous or original assembly, the locational accuracy of the re-fitted scope will be determined by the surface finish accuracy of the mated surfaces rather than the width tolerances if the key and keyway. Also if machining error of a key is found to be concentrated on one side of the key, then for a scope assembly having two keyed mount blocks, the two keys can be assembled, one forward, and one back, so that the scope would be torsionally preloaded in a manner that would tend to cancel out the angular misalignment.

Figure 5A:
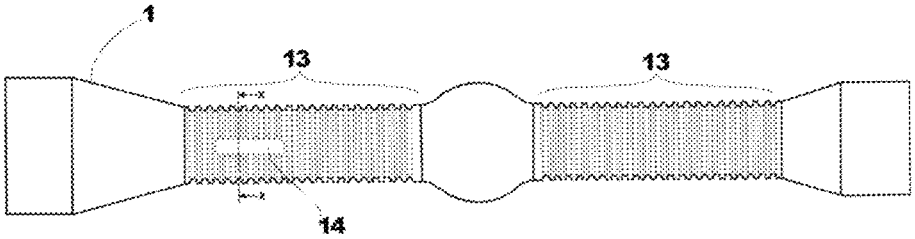
FIG. 5*a* shows cross section of a ribbed scope in accordance with the invention and defines a section line x-x for the cross section view of FIG. 6.

FIG. 5*a* shows cross section of a ribbed scope [1] in accordance with the invention. At least one of the tubular sections of the scope includes grooves cut into it to produce ribs between these grooves. The grooves run transverse to the longitudinal axis of the scope, so that at least one groove surface runs perpendicular to the longitudinal axis. A groove or rib can also include a conical surface or an annular surface, and in this specification the conical surface is defined as "perpendicular" if its axis of rotation is parallel to the longitudinal axis of the scope.

Figure 5B:
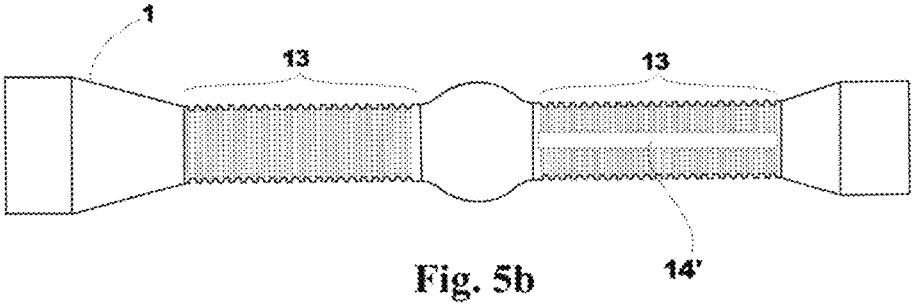
FIG. 5*b* shows cross section of a ribbed scope in accordance with the invention and having a keyseat which extends throughout an entire set of ribs.
Figure 5C:
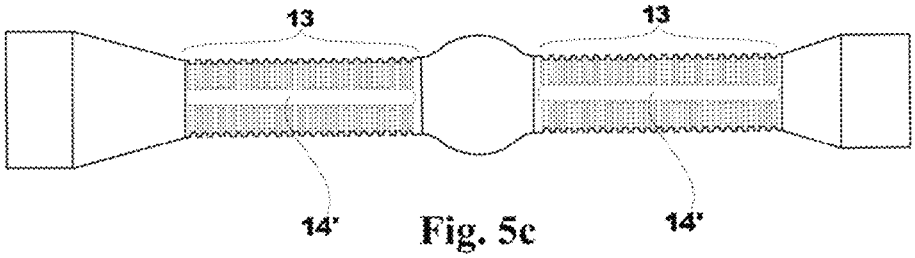
FIG. 5*c* shows cross section of a ribbed scope in accordance with the invention and having a keyseat on each of its tubular sections, each of which extend throughout an entire set of ribs.
Figure 6:
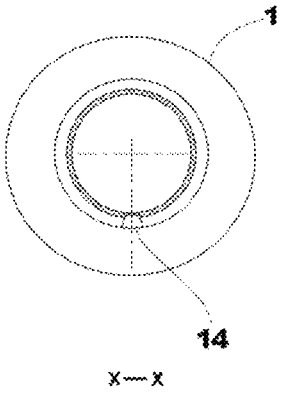
FIG. 6 shows a cross section through a ribbed scope in accordance with the invention, taken through the section line x-x defined in FIG. 5*a*.

FIG. 5 also defines a section line x-x for the cross section view of FIG. 6. The scope shown has two sets or pluralities of ribs [13] axially spaced apart along the longitudinal axis of the scope. The profile of the spaced-apart ribs may be square, embattled, sawtooth, dancetty, sinusoidal, wavy, invected, engrailed, or any other profile repeated periodically along a constant longitudinal pitch.

Groove and land systems that are formed with rounded groove bottoms and matching rounded lands provide contours on the scope tubes with minimal notching and stress concentration features. This reduces the tendency for cracking of the scope tube due to stress concentrations at the groove roots. The rounded form also provides a smoother, more positive assembly of scope within its clamps and minimizes the potential to mismatch the grooves and lands when clamping, while effecting a positive lockup of the scope clamp assembly components.

The grooves in the mount blocks are complementary to the ribs on the scope. The scope also includes at least one keyway [14] cut into at least one of the sets of ribs. In the best mode, the keyway is cut into the nadir line or bottom of the scope, also referred to as the "six o'clock position."

A key in accordance with the invention may be of a plain square or rectangular cross section, or may be a woodruff key or a feather key. The keyseat shown in FIG. 5*a* is of a modest length. A long keyseat even such as one traversing an entire set of ribs [14'] on the scope body, as shown FIG. 5*b*, is a desirable embodiment and is included within the scope of the invention. FIG. 5*c* shows another ribbed scope [1] in accordance with the invention and having a keyseat [14'] on each of its tubular sections, each of which extend throughout an entire set of ribs [13.] The keyseat on the scope can be cut into the tubular section of the scope and can extend over an entire length of the tubular section of the scope. In FIG. 5*c*, the scope has a first and a second tubular section and a first and a second keyseat cut along these sections respectively.

In such an embodiment, a key deposited in the mount block and confined in the axial direction of the scope and mount block assembly still allows a ribbed scope of the invention to be seated in any of the periodic repeated grooves of the mount blocks of the invention so that the scope may be secured at a number of axial positions within the scope and mount block assembly.

Captured keys are preferred for the mounting blocks of the invention. Keys may be effectively trapped in their keyseats by having keyseats include blind ends or widths too narrow for a key to pass. Keyseats in mounting blocks should also be cut deep enough to accommodate the full diameter of the ribs of a scope of the invention.

FIG. 6 shows a cross section through a ribbed scope [1] in accordance with the invention, taken through the section line x-x defined in FIG. 5. In this view a trapezoidal keyway [14] is seen at the six o'clock position defined above.

The benefit of being able to dismount a scope at one axial position and re-mount and secure it at another axial position such that the original zeroed-in state of the scope is reestablished shall now be explained in further detail.

A telescope sight is manufactured which includes at least two straight cylindrical tube sections formed with a set of equally spaced ribs, each having identical profiles, along a length of each cylindrical tube section. The ribs and grooves produce major and minor diameters by which the ribs and grooves on the scope mesh with the grooves and ribs in the mount block. The cylindrical surfaces located at the minor inner diameter of the mount block form lands that are mated to the grooves' inner surfaces located at the smaller minor diameter in the scope. The cylindrical surfaces at the major outer diameter of the scope tube form and comprise a set of lands as a mating surface to the grooves located at the major diameter in the mount blocks. The telescope sight is supplied with two split-ring clamping scope mounts, with mount blocks having grooves complementary to the ribs of the scope, with lands between the grooves having a minor inner diameter complementary to the major outer diameter of the lands of the scope as described above.

The clamp is formed when clamp members, also having grooves and lands identical to those in the mount blocks and complementary to the ribs and lands of the scope, are drawn down onto the mount blocks by screws, to clamp the scope between the clamp members and the mount blocks and form a meshing joint. By careful configuration of the land and groove profiles, a clamp joint with an interference fit is established, thus eliminating all axial and radial clearance. Unlike friction clamps of other scope mounting systems, the intermeshing of ribs and grooves absolutely prevents any axial slippage of the scope with respect to the mount components or the rest of the rifle. Also, besides a set of equally spaced apart grooves, a constant-pitch helical system with the mount blocks comprising internal thread surfaces and the scope comprising external threads also resides within the scope of the invention.

In a best mode embodiment, the scope and mount block assembly further comprises a key with at least one of the mount blocks having a keyseat adapted to receive the key, and with the underside of the scope also having a keyseat adapted to receive the same key. The groove and land pattern is formed with each groove and land being cylindrical about an axis of rotation defined by the longitudinal axis of the scope body. When properly installed and clamped by screws, the axes of rotation of the lands and grooves of the clamp member and the lands and grooves of the mount block both become coaxial to the axis of rotation defined by the ribs and lands of the scope body.

Either a system of helical grooves and lands, or a set of uniformly axially spaced circular grooves and lands system may be employed. For helical systems, a single thread or a multiple-start thread system may be employed. The circular groove system is equivalent to a multiple-start helical system having a helix angle of zero. The groove and land systems described here are specified with similar terms used to define threads: pitch, major diameter, minor diameter, pitch diameter, truncation, depth of engagement, basic form of thread, or commonly known thread profile names. Thus a power thread can be specified and understood to be a system having a square or trapezoidal thread profile as a basis or a module for the entire engagement system. The main advantage of a helical configuration is the manufacture of grooves, lands, or vee threads may be less time consuming and more economical than non-helical grooves and lands.

In addition to the ribs and lands to a telescopic sight's external contour, and the grooves and lands of the mount components being able to positively eliminate axial scope shift due to recoil or other shocks, an axially extending keyseat is added to the bottom of the scope body, and a complementary groove, also extending axially, is incorporated in the inside bottom of the mount blocks of the invention. This groove is a longitudinal groove and not a transverse groove.

When both keyseats are angularly aligned, they define a contiguous volume into which a complementary and closely fitted key is deposited. Precision manufacture and the biasing of all mating surfaces to a single local datum scheme will establish a non-slip, positive, non-rotating, locking joint. In a preferred mode, the keyseat groove in the scope body is precision formed in the exterior lower straight tube sections of the scope body, and this keyseat groove is aligned with the vertical and horizontal reticles in the scope viewing picture. Likewise, complementary precision keyseat grooves formed in the mount block bore of the clamp member and mount block assemblies provide precise, reliable, and repeatable vertical and horizontal alignment of the scope in the clamp member and mounting block assembly.

To change the location of the scope in an axial direction defined by the scope and mount block assembly of the invention, the clamp members are loosened and removed from their attachment to their mount blocks. The scope is un-meshed from the mount blocks and then moved forward or rearward by a desired amount and then replaced into the mount blocks so the scope's ribs intermesh with complementary grooves of the mount blocks, and then the lands of the scope seat upon the lands of the mount blocks. The clamp members are then reinstalled and the assembly is re-clamped, completing the installation and adjustment. The scope can fit anywhere that both mount blocks can engage the scope ribs, because the second plurality of spaced apart transverse ribs is aligned on pitch with the first plurality of spaced apart transverse ribs.

Note that although the nature of the transverse groove and land configuration limits adjustments to the axial location of the scope to discrete increments defined by the pitch of the groove and land system or module, an appropriately fine-pitched system can be designed in accordance with the invention so that any axial location preference which does not exactly reside within the defined set of discrete locations can be reasonably accommodated by the shooter moving his or her head by the slight, remaining non-integer fraction of the defined pitch. The burden of this slight accommodation for discrete axial positioning options for the scope is more than overcome by the benefits of a robust and slip-proof scope mounting system.

The degree of improved robustness of this system over existing systems can be compared to the axial holding strength of a nail in lumber versus a threaded wood screw in lumber. If the nail is greatly loaded in tension or compression, it will move axially—it can be driven further into the lumber or it can slip out. In either case the unwanted motion is a failure of the system to withstand the axial force by means of friction alone. In the case of the wood screw being driven deeper or pulling out, a material rupture of the lumber would need to occur. The scope and mount block assembly of the invention also obviates frictional coefficients as the threshold of failure; instead, material rupture of metal components would be required for the scope to axially slip out of its desired position.

Furthermore, the key and keyseat system of the invention positively excludes rotational misalignment or drift over any interval of repeated shocks. When the scope is removed from its mounting components, it is possible to replace the scope and key into the rings and re-clamp in a repeatable, secure junction. Scope tubes provided with a key groove along the bottom in accordance with the invention provide the ability to automatically align the scope with the matching keyed split ring, assuring precision angular alignment about the scope's major axis.

Most scope mounting systems attach a scope to a firearm indirectly through some kind of intermediate mounting plate, which can be a discrete part attached to the firearm or is an integral set of mounting features machined or fashioned into the firearm itself. Where mounting plates are discrete components, they are usually precision-installed by qualified technicians to a factory specified precision based on the intended use and market for the firearm.

Typically, initial zeroing-in of a scope mounted to factory-installed or after-market mounting features allows consistently accurate shooting provided the zeroed-in scope does not slip within its mounts and the scope mounts do not slip at their attachment points to the mounting features installed on the gun. The process of zeroing-in compensates for any scope-to-bore misalignment inherent in the mounting interface between the mounting features and the firearm itself.

As previously discussed, although the mounting features supplied with or machined into most rifles position the axis of the scope to be directly atop the shooting axis of the firearm, in some designs or in a particular specimen where these features are mis-machined, a custom key offering a compensating angular offset can be furnished such that a scope in accordance with the invention can be positioned in a preferred position directly atop the shooting axis of the firearm. By using such special or custom keys, angular misalignment in original installations can be corrected if required.

One particular embodiment of a custom key will be explained in further detail here. Special keys can be implemented to allow small rotational adjustment for firearms where the rails or other mounting adapter plates are installed with angular misalignment about the firearm's longitudinal axis:

A keyseat in the mount block can be cut to a width substantially wider than the corresponding keyseat in the underside of the scope tube. The keys used are designed as an inverted "T" similar to FIG. 4*b*, where the horizontal portion of the tee is 3 times the width of the vertical portion of the tee. For example, a key may be manufactured with an included width of its horizontal base being 9 millimeters, and the width of a vertical "post" portion of the key being 3 millimeters. Although for a standard key the post would typically be centered over the base, a custom key can have the upper post position offset from the centerline of the base width.

The width of the keyseat in the bottom of the mount block where the base of the key is inserted is also 9 millimeters. The width of a key slot in the bottom of the scope tube is 3 millimeters. When the scope, mount block, and clamp member are properly assembled onto a mounted rail or other mounting adapter plate installed on the firearm, then when using a standard key the scope is aligned vertically above the firearm's bore, and this assembly process achieves a firm, secure, and repeatable installation.

In situations where the horizontal plane of the mounting rail, or other mounting system is not installed perpendicular to the vertical axis of the bore, an angular misalignment is said to exist, and if not too severe a special or custom key can be fabricated to correct for the angular misalignment. The post portion of the key, which engages the keyseat in the scope tube, can be made off-center by an appropriate amount so that when assembled, the scope can be shifted on its rotational longitudinal axis so that it encounters the top post of the key when horizontal elements of the sight picture of the scope are perpendicular to surfaces and datums of the rest of the fire arm which the shooter expects to be held vertical while aiming or shooting, thus correcting for the misalignment.

Some scope mounting systems have been developed and implemented across many types and models of firearms, such as NATO, Picatinny, and Weaver Intermediate Mounting Bases and Rails as various methods used to mount a scope-ring assembly to the firearms. Most use various and specific mounting adapter plates; each having its own characteristics, advantages, and limitations.

The NATO/Picatinny mounting rail bases have been developed over the years and resemble older Weaver designs. The Picatinny rail mount specification predates the nearly identical NATO specification. Because the Picatinny rail system has become quite popular and prevalent, and the NATO rail system is essentially an updated version of the Picatinny system, key features of the invention have been adapted to integrate with these systems.

Mounting rail systems usually consist of a mounting plate or strip having a dove-tailed cross section extending at least partially along the longitudinal axis of a firearm. The rail is slotted by rectangular grooves and mounted on a surface where accessories including telescopic aiming devices are mounted. These grooves are perpendicular to the longitudinal axis of the firearm and can receive complementary lugs or tabs included in the clamping systems of scope mounts and various other accessories. The grooves and lugs of a rail mount system provide longitudinal location for these ancillary components and resist the recoil forces while the firearm is discharge and also resists unwanted displacement of the accessories during impacts and shocks encountered during field conditions and while in transit.

The grooves are spaced along the length of a rail using a standardized pitch. Picatinny groove spacing is specified at 0.394 inches from the middle of one groove to the middle of the adjoining groove. NATO groove spacing is specified at 10 millimeters between groove centers. The spacing of the Picatinny grooves is actually a three-place decimal round-off conversion of 10 millimeters to US customary inches.

Since the groove pattern or pitch is consistent over the length of the rail, scopes may be mounted anywhere along the length of the rail. When scopes are mounted, usually two mounting rings are used which are spaced apart by a distance that is a multiple of the rail spacing pitch of 10 millimeters, and thus the scope ring assembly can be placed anywhere along the length of the rail in increments of 10 millimeters to adjust for preferred eye relief.

Most scope tubes are configured with a central straight tube section of the body interrupted by a larger diameter or bulged central section dividing the tube into a forward and rearward straight sections. The larger diameter section is usually of short length and houses elevation and windage adjustment mechanisms, reticle, and illumination features. For the grooved scope and ring assemblies of the invention to mesh correctly onto NATO and Picatinny rail systems, the separation of a first series of ribs forward of the central bulged section and a second series of ribs aft of said central bulged section is defined as an exact integer number of missing ribs. In other words, the distance from any inflection point or corner point of a rib profile forward of the central bulge section to any other corresponding inflection point or corner point of a rib profile aft of the central bulge section is a numerical value which is an exact integer multiple of the linear pitch of the rail system. Thus when mounted to a 10 mm rail system, the two sets of rings must end up spaced along some multiple of 10 millimeters, and both will mesh simultaneously with forward and aft sets of ribs and lands on a scope tube body when these also have been cut to a 10 mm pitch system or module.

In the preferred embodiment of a ribbed scope having more than one set of ribs, the pitch of the grooves and lands on the scope tube must be held continuous throughout the front and rear scope tube sections. The front and rear clamp assemblies are then spaced apart by a distance that is an integer multiple of the pitch of the scope's groove and land system.

In an alternative embodiment in accordance with the invention the scope has only one set of axially spaced apart ribs (preferably aft of the central bulge section of the scope,) and the forward portion of the scope tube would remain a smooth cylindrical surface, like a conventional scope. For this scope mount system, the rear mount block and clamp member have grooves and lands complementary to the ribs and lands of the scope, while the forward mount block and clamp member have smooth, cylindrical interior surfaces which match the smooth tube portion of the scope.

Although two or more pairs of grooved mount blocks and clamp members meshed with ribs of a scope are preferred, one grooved-landed ring can be sufficient to eliminate the dependence on the friction joints typical in previous designs. Where only one clamp assembly includes grooves, other clamps of the smooth-bore style still provide radial stability. When only one grooved clamp is used with a scope having more than one set of ribs, the need for pitch alignment between one set of scope ribs and another set of ribs is obviated.

In a preferred mode offering maximum flexibility of the longitudinal adjustment of the groove-land scope and ring assembly, the groove-land pitch of the scope/ring joint are made to be a standardized fractional factor of the 10 millimeter pitch of the Picatinny/NATO groove spacing. Theoretically, 1:1, 1:1/2, 1:1/3, 1:1/4, 1:1/5, through 1:1/10 are all likely alternative ratios for the rail to scope-to-ring groove-land pitches. The scope can be moved within the rings themselves to achieve finer longitudinal placement according to the scope/ring groove-land pitch selection used in the manufacture of the scope and rings.

As will be seen below in the detailed explanation of FIG. 7, the ring-to-rail pitch of 10 millimeters allows the scope and ring assembly to be positioned to within 5 millimeters or less to any specified position:

A 1:1 ratio on the rail to scope/ring groove spacing pitch provides scope positioning the same as the ring-to-rail adjustment to within 5 millimeters of a specified position.

A 1:1/2 ratio on the rail-to-scope/ring groove spacing pitch, allows scope positioning to 2.5 millimeters or less.

A 1:1/3 ratio on the rail to scope/ring groove spacing pitch allows scope positioning to 1.67 millimeters or less.

A 1:1/4 ratio on the rail to scope/ring groove spacing pitch allows scope positioning to 1.25 millimeters or less.

A 1:1/5 ratio on the rail to scope/ring groove spacing pitch allows scope positioning to 1 millimeter or less, and a 1:1/10 ratio on the rail to scope/ring groove spacing pitch allows scope positioning to 0.5 millimeters or less.

Thus a predetermined ratio of 1:1/n is established between said pitch p/n of said spaced apart scope grooves and said pitch p of said spaced apart mount block protuberances, where n is an integer.

Another detail of the invention is the establishment of a direct relationship between the grooves and lands in the clamping members and mounting blocks, and the grooves and lands on the Picatinny/NATO rail or any equivalently-spaced mounting system: The mount blocks have a second portion which is usually an underside, having means for clamping to a mounting rail, so that when the set of centerlines of the scope-engaging grooves or lands of a mount block align with a corresponding set of centerlines of grooves or lands on the second portion or underside of the mount block for engagement to features in the rail mounting system, then the adjustment resolutions previously listed for incremental scope-to-mount block adjustments can be achieved directly as equivalently incremental scope to rail-system adjustments.

For example, when the centerlines of the scope-receiving grooves or lands of the mount blocks are offset forward or rearward with respect to centerlines of the grooves and lands on the underside of the mount blocks which are adapted to register with spaced-apart features on a mounting rail system, and the offset distance is ¼ of the value of the pitch of centerlines of the scope-receiving grooves then, as long as the mount block can be attached to the mounting rail system in both a forward facing orientation and a rearward facing orientation rotated 180° from said forward facing orientation, then scope positioning can be incrementally adjusted by ½ of the distances determined above for the same rail pitch-to-bore groove/land pitch ratio, or even less.

Figure 7:
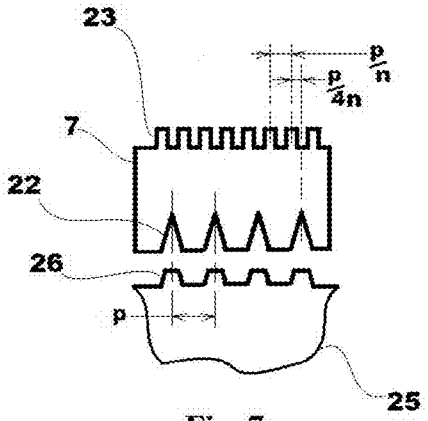
FIG. 7 shows a mount block being fit onto a standard rail mount system having spaced-apart features.

FIG. 7 shows a mount block [7] being fit onto a standard rail system mounted on or integral to a firearm [25.] The standard rail system has a set linear spaced apart array of positive features [26] typically extending in an axial direction related to the shooting axis of the firearm. In this example the mounting rail system features are set at a pitch of p in the figure. The underside of the mount block has a spaced apart array of notches [22] or protuberances complementary to the rail system features, so these too are spaced apart to define a longitudinal pitch p. It is of course within the scope of the invention that a standard rail system will have grooves or slots cut into the firearm or a rail component mounted to it, and the underside of the scope block would have complementary protuberances adapted to engage with the grooves or slots.

The first portion of the mount block has spaced apart grooves and lands complementary to and adapted to receive the ribs and lands of a ribbed scope of the invention, as explained previously. However, the pitch of these engagement features is in accordance with the ratios discussed above, and is here designated p/n. The value n may be 1, 2, 3, 4, 5, or 10 to create the desired rail to scope/ring groove spacing pitch ratio as described. They value of p/n may also me any other figure for the purpose of enabling incremental adjustment of eye relief for a scope mounted on a rifle.

For scope mount systems in accordance with the invention wherein n is an integer value, if a feature centerline of the underside groove and land set [22] is aligned with a centerline of the upper groove and land set [23,] then every other centerline of the underside feature set will also align with a centerline of the upper groove set. However, provided that both feature sets are repeti-tions of features having axial symmetry, (that is, each feature defines a plane of symmetry and these planes are longitudinally spaced apart on a constant pitch,) then the mount block can be dismounted and reversed and will still engage properly with the set of features incorporated in the standard rail mount system, because a mount block groove for receiving a scope rib defines a first plane of symmetry, and a mount block protuberance for engagement with a mounting rail defines a second plane of symmetry, and these planes of symmetry are longitudinally spaced apart by a predetermined distance.

With this option understood, it is also possible to offset the upper groove system [23] from the underside system [22] by a length dimension. If this is done, then mounting the mount block in a forward facing orientation will advance the scope by the offset length, and mounting the block in a rearward facing orientation will retract the block (reducing an eye relief distance) by that offset dimension. In a preferred embodiment as shown in the figure, the offset is p/4n, which means one quarter of the pitch of the upper ribbing and groove intermating system [23] of the invention. Using this offset, the spacing of the set of incremental positions available for the scope with respect to the rest of the rifle becomes half that of the upper pitch value.

In this specification, the word "profile" is used pertaining to a transverse rib or a groove, and the cross-sectional profile may be described using a word typically defining a closed shape such as a square, a trapezoid, a triangle, a semicircle, a sine curve, and a cosine curve. The sets of grooves and ribs in the tubular sections of the scope and complementary grooves and ribs in the first portion of a complementary mount block may include any of these profiles.

In this specification, the profile includes all contours and segments of the word in its common usage, less one horizontal segment which must be the root or attachment to a scope or a mount block being discussed. Thus a "square" profile of a rib for a scope of the invention includes two vertical walls and a top surface which will be a cylindrical surface. The fourth or bottom side of the square is omitted from the definition of a "square" profile as used in this specification. Similarly, a "triangular" or "trapezoid(al)" profile will also omit the horizontal base segment associated with the geometrical shape name word.

Figure 8:
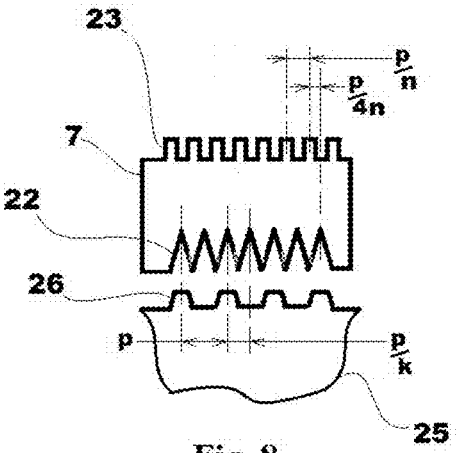
FIG. 8 shows a mount block of an alternative embodiment being fit onto a standard rail mount system having spaced-apart features.

FIG. 8 shows a mount block [7] of an alternative embodiment being fit onto a standard rail mount system having spaced-apart features [26.] In this mount block the pitch of the underside mating features [22] of the mount block equals the pitch p of the standard rail mount system is divided by an integer k so that the position of the mount block on the standard rail mount can be adjusted by a finer increment p/k. The upper groove system of this block operates the same as described in FIG. 7.

Another advantage to the system is that where n is an integer, then a ribbed scope having ribs spaced on any integer multiple of p/n can mesh with the upper groove and land set [23.] Finer scope/ring groove-land pitches can be used, but practical considerations limit the selection to groove-land forms and sizes that will resist damage from use while still assuring positive mesh of the scope and ring joint without misalignment.

One possible form for the groove and land geometry is a low profile, wide groove and land, with 15° tapered sides. This resembles a modified form of the industry standard acme thread form or the more common high profile 60° vee-groove profile, with vees truncated to leave 80% height of the crests.

A specific description of a preferred groove-land geometry in accordance with the invention is a modified Acme profile geometry with 5 millimeter groove-land pitch, equal width grooves and lands, 1 millimeter total groove-land depth, with 34 millimeter diameter land, 10% truncation of external scope body lands, and internal cylindrical lands, forming 80% overlap and engagement of the scope and ring meshing joint. Groove and land surfaces are formed at 15° from the vertical height, with 0.2 millimeter radii at groove roots and land corners. The groove and land system centerlines on the upper side of the mount blocks are offset forward from the centerlines of the underside groove and land system by ¼ of the pitch the upperside system pitch. Such a mount block will match and mate with the Picatinny/NATO rail configuration. The angled groove and lands, with truncation, provide a meshing joint between the scope and mount blocks which when clamped, positively eliminates any longitudinal and radial clearances between the respective parts. Such joints prevent the scope or accessory from shifting longitudinally and radially, maintaining a rigid and consistent mounting, and yet allowing removal of the scope from mount blocks without binding or sticking.

Overall diameters of the groove and land profiles on the scope tubes is also important. Scopes with smooth tube diameters of ¾ inch, ⅞ inch, 1 inch, 30 millimeter, 34 millimeter, and 35 millimeter are available, with 1 inch, and 30 millimeter probably being the most used.

Three approaches can be utilized for forming the groove and land diameters on the scope tubes:

1) Adding the height for a sufficient land to the diameter of the existing radius of a scope tube to provide material for groove and land formation allows implementation of this mounting system without need to change internal dimensions of current scope designs, but this method may require the mount blocks to include a non-standard bore size in the components comprising the clamp assembly.

2) Increasing the height of a land to match the internal diameter of typical mounting rings used for the next larger size of scope tube. This approach allows implementation of the groove-land mounting system without internal modifications to the current scope designs, and still allows the scope to be mounted with commercially available internally smooth rings. However, some commercial scopes in available today have tube diameters which are too large than this approach can accommodate. The largest existing scope diameter, when expanded for grooves and lands, of course, would have no larger existing commercially available rings to utilize. Custom rings would need to be formed to accommodate tube diameters such as 34 millimeter or 35 millimeter scope tubes, and these would have to include sufficient outer diameters to provide enough additional land height for effective engagement.

However, for scope tube diameters where this approach is feasible it may also be the most economical method. Since most telescopic tubes are precision machined on numerically-controlled (NC) machinery, the groove-land features on the tubes reside within a volume of material which is already invariably present at this stage of the machining process for manufacturing a scope. Since the entire volume of material is normally removed, a ribbed scope in accordance with the invention may be revealed by a change in programming, and perhaps an additional turning tool may also be required. Machining time and tool wear are reduced by an extent likely to offset the cost of the additional cutting tool.

Likewise, if the clamp components of the invention are also formed by NC machining, the bores of the corresponding clamp members and mount blocks may be machined undersize, and then matching groove-land profiles can be machined as well. However, additional capital investment in fixturing changes may be required to accommodate any bore diameter changes in the clamp components.

3) The third approach is to subtract the depth of grooves from the existing diameters of scope tubes to provide sufficiently deep grooves for engagement with the grooves and lands in the clamp components, while maintaining land diameters that match standard scope tube diameters.

This may require changes to the internal design of existing scopes, but would still allow the scopes to be used in existing commercially available smooth-bore rings that do not have the groove-land technology features. This approach provides versatility in selection of either finding components having a matching groove and land system complementary to the rib system of the scope, or using smooth mounting rings. This may well prove to be the best long-term approach to promulgating and disseminating the technology and encouraging market adoption of the invention. Of course, clamp components having the groove and land systems in accordance with the invention will need to be developed and produced for each standard scope tube size.

Furthermore, many manufacturers have developed mounting systems that include proprietary mounting adapter systems which utilize smooth-bore split-ring clamping scope mounts. When mounting rings of such systems the distances from the centerlines of each mounting point are not standard and may be varied. Mounting a smooth-tube scope into clamp assemblies of the invention is feasible independent of whatever groove and land systems are present within the clamp assemblies, because a smooth-tube scope will simply fit anywhere along the length of the longitudinal axis. However, the benefit of robust elimination of scope slip provided by the invention will not be available in this configuration because the smooth-tubed scope has no complementary features to engage the ribs and grooves in the mounting blocks.

To create mounting blocks in accordance with the invention which engage with and attach to a proprietary mounting system, two conditions are desirable:

1) The actual centerlines of the clamp/mounting features on the bottom of the mounting blocks must be aligned to match the required centerlines of the mounting features of the proprietary system and, 2) the continuous rib-groove pitch relationship between the fore and aft ribbed sections on the scope tube where the clamp/mounting blocks are assembled must be maintained.

To achieve this adaptation, the mounting features and locations on the underside of the mount block must be specified to match each proprietary mounting system. Once the proprietary mount block bottom clamps are secured, the primary benefits of the invention can be utilized, which are positive scope to ring mount clamping with fore and aft adjustment for eye relief as provided by the ribbed and grooved scope and mounts, and precision vertical and horizontal alignment and perpendicularity as provided by the keyseats in the scope and mount block assembly and the installed matching alignment key.

Although it is also possible to use only one grooved mount block of the invention and having all other scope clamps be designed as smooth-bore clamps obviates the challenge of aligning the pitch of a proprietary mounting system to the pitch of a ribbed scope mounting system of the invention. Where this approach is taken, the ribbed clamp assembly should be located as the rearmost clamp of the set of scope clamps affixed to the proprietary mounting rail. It is also similarly obvious that for every different proprietary adaptation, a complementary clamp assembly or set of mounting features is required, and especially that the pitch and centerlines of the underside set of engagement features of a mount block relate to the pitch and centerlines of the upper groove and land system for a ribbed scope of the invention, including the optional offset between these pitches as described previously.

In another preferred embodiment, the pitch of the mounting features on the bottom of mount blocks designed to accommodate a proprietary rail mounting system is less than the pitch of the upper groove and land system for a ribbed scope of the invention.

Figure 9:
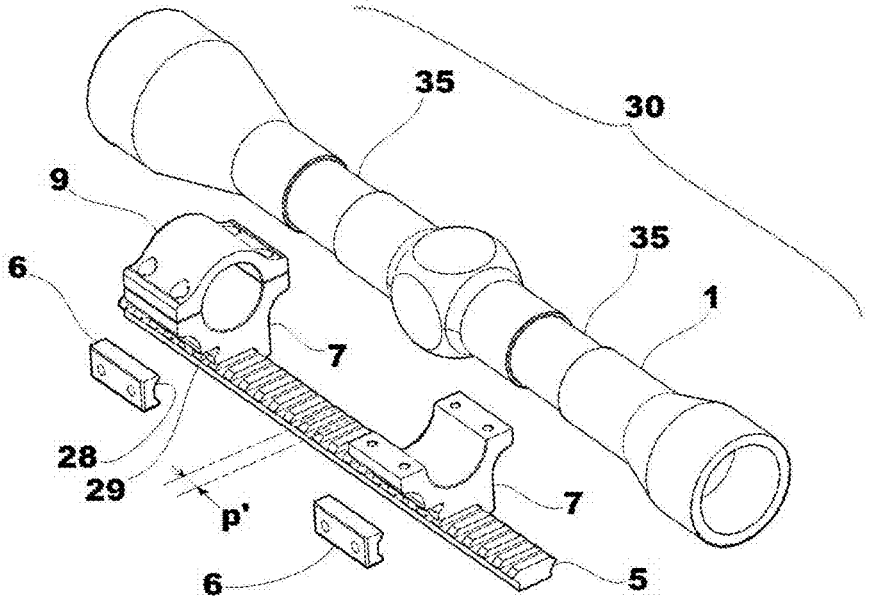
FIG. 9 shows a scope and mount assembly in accordance with the invention.

FIG. 9 shows a scope and mount assembly [30] in accordance with the invention. A Picatinny rail [5] or a similar set of repeated features machined or provided on a rifle includes an elongated hexagonal cross section with a pair of angled surfaces at each side of the rail. Mount blocks [7] include repeated features complementary to those on the rifle or rail on their undersides. One side of the underside of a mount block has a downward projection with a longitudinal cut having two angled surfaces complementary to the pair of angled surfaces on the rail to which it engages. The opposite side has a groove [29] with an angled surface which engages with an angled surface [28] on a rail clamp [6.] Another angled surface of the rail clamp engages the underside angled surface on that side of the rail. A best mode rail clamp is designed with a symmetrical cross section and symmetrical fastener holes so that it can be installed onto the rail and mount block in more than one orientation while providing equally effective clamping and gripping of the mount block onto the rail. Each mount block receives a clamp member [9] which is attached by fasteners. For each set of mount block and clamp member, the scope [1] of the assembly includes a groove [35] into one or more of its tubular portions. The groove presents a transverse surface perpendicular to the axis of the scope, which abuts a complementary transverse surface on the first portion of a mount block when all is assembled.

Although this embodiment does not orient or register a horizontal demarcation of the reticle of the scope to a horizontal reference of the rifle or the mounting rail, since the groove lengths are precisely matched to the lengths of the mount blocks, longitudinal positioning of the scope is achieved and is especially robust against slipping of the scope within its mounts during recoil. Rotation of the scope within its mounts is prevented by clamping friction developed between the top block and the mount block. This embodiment does not preclude the incorporation of the longitudinal key and keyseat features described previously.

The spacing of the repeated features of the mounting rail is designated here as p' and as explained above, the ratio of the pitch p' to the pitch of complementary repeated features (p/k in FIG. 8) in the underside of the mount block must be an integer to integer ratio. Thus the setback distance of the scope to the shooter's eye, brow, or forehead can be adjusted to any personal preference within an interval of p/k.

Figure 10:
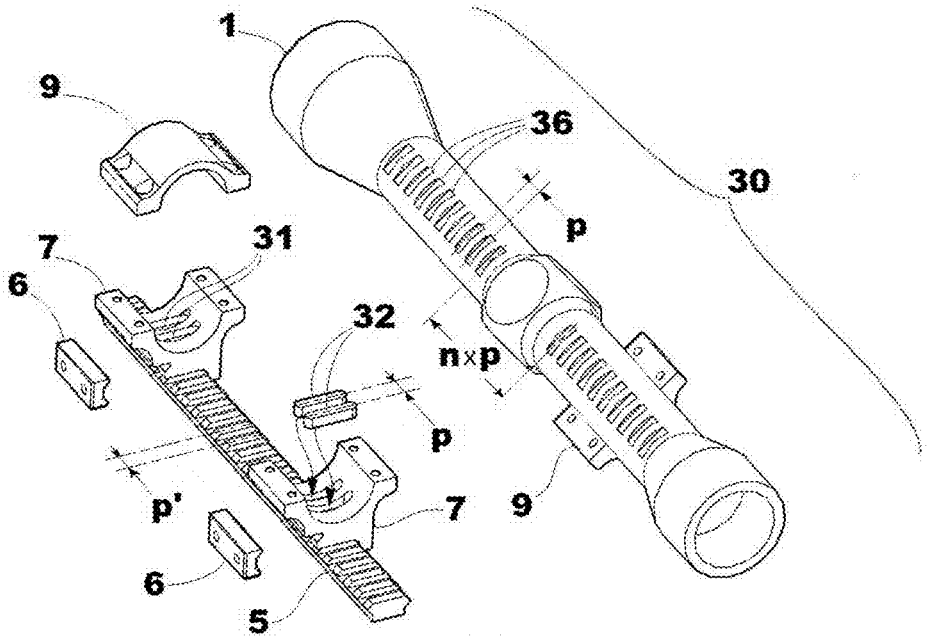
FIG. 10 shows another scope and mount assembly in accordance with the invention.

FIG. 10 shows another scope and mount assembly [30] in accordance with the invention. The mount blocks [7,] rail clamps [6,] and clamp members [9] are similar to those previously described, but in this embodiment the scope [1] has at least one set of transverse grooves [36] milled into at least one of its tubular sections. A best mode has two tubular sections and a set of regularly spaced grooves in each section. The grooves are spaced apart on a pitch p and the spacing between the first and second set of grooves is such that the distance between the last groove of the first set and the first groove of the second set is an integer n times p (n×p) as shown.

The relationship between the pitch p of the repeated features [36] of the scope and the pitch p' repeated features of a mounting rail [5] of a rifle is as described for FIG. 9. In this embodiment, the mount blocks have transverse keyseats [31] in them which are also spaced apart on a pitch p. Transverse keys [32] are fitted into these keyseats, and for reversibly mountable mount blocks the advantageous offset p/4 between the transverse keyseat centerlines and the centerlines of repeated underside features of the mount block which intermate with the repeated features of the rail confers the same fine adjustability of scope setback as is described for FIGS. 7 and 8.

Figure 11:
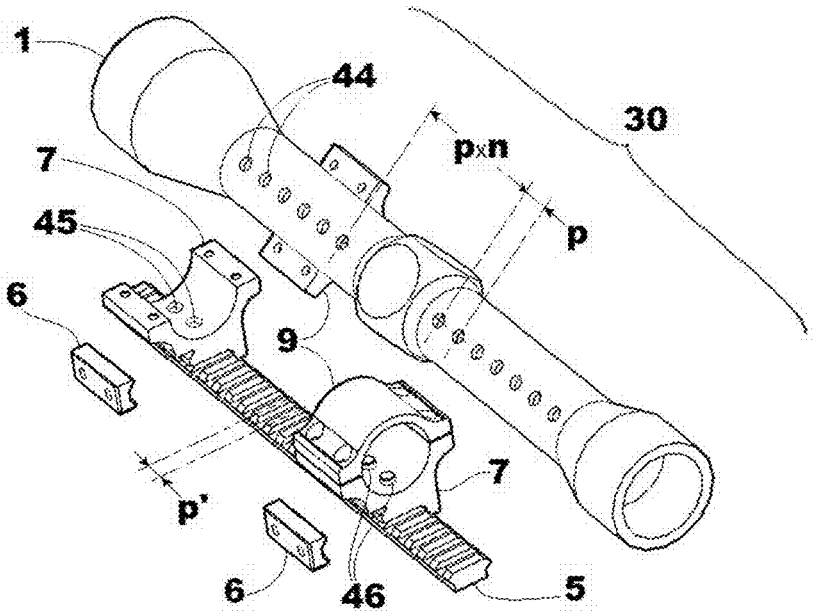
FIG. 11 shows another alternative scope and mount assembly in accordance with the invention.

FIG. 11 shows another alternative scope and mount assembly [30] in accordance with the invention. The rail [5,] rail clamps [6,] one or more mount blocks [7] having in their second portions means for clamping to a mounting rail, and clamp members [9] are as described in previous figures. In this version, the scope [1] has at least one linear array of longitudinally spaced apart blind apertures [44] in the underside surface of one or preferably two of its tubular sections. The tubular sections of the scope [1] are received into semicircular concavities of the mount blocks. One or more longitudinally spaced apart apertures [45] cut into a mount block located along the nadir line of these semicircular concavities receive dowel pins [45] which may be press-fit or threaded or in other ways firmly or permanently received therein. An alternative embodiment within the scope of the invention has pins permanently received into apertures cut into one or more tubular sections of the scope, and these pins are received into one or more apertures cut into the first portion of a mount block. Where the pitch of the apertures on the underside of the scope is p, and two or more linear arrays of apertures are cut into the tubular sections of the scope, the spacing between the last aperture of one linear array of holes and the first aperture of the next linear array of holes is a distance n times the pitch p (n×p) where n is an integer.

As explained in FIG. 9 above, the spacing of repeated features of the mounting rail [5] is also designated here as p' and as explained thereabove, the ratio of the pitch p' to the pitch of complementary repeated features (p/k in FIG. 8) in the underside of the mount block must be an integer to integer ratio. For reversibly mountable mount blocks, the offset of p/4 between the aperture [45] centers and the centerlines of repeated underside features of the mount block advantageously intermate with the repeated features of the rail, thus conferring the same fine adjustability of scope setback as is described for FIGS. 7 and 8. Thus the setback distance of the scope to the shooter's eye, brow, or forehead can be adjusted to any personal preference within an interval of p/k.

Figure 12:
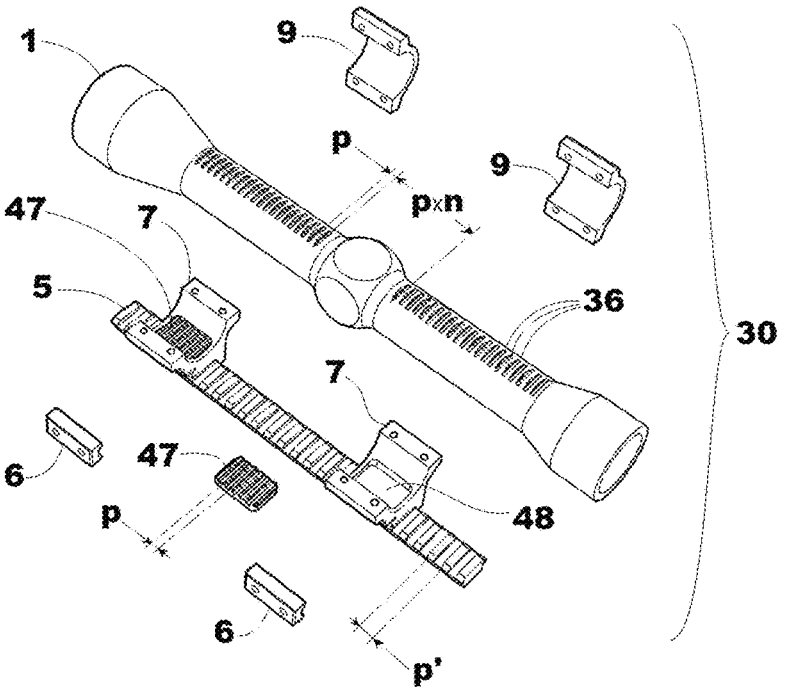
FIG. 12 shows yet another alternative scope and mount assembly in accordance with the invention.

FIG. 12 shows yet another alternative scope and mount assembly [30] in accordance with the invention. The rail [5,] rail clamps [6,] mount blocks [7,] and clamp members [9] are as described in previous figures. In this version, similar to FIG. 10, the scope [1] has at least one linear array of longitudinally spaced transverse grooves [36] in the underside surface or one or preferably two of its tubular sections. The grooves are spaced apart on a pitch p and as in FIG. 10, the spacing between the first and second set of grooves is such that the distance between the last groove of the first set and the first groove of the second set is an integer n times p (n×p) as shown.

The tubular sections of the scope are received into semicircular concavities of the mount blocks. The mount blocks in this embodiment include keyseats [48] cut into the semicircular concavities. Keys [47] include transverse ribs spaced apart on the same pitch p for intermating with the complementary grooves [36] in the underside of the scope. As in previous embodiments, the mount block is preferably reversibly mountable to the rail, with the keyseat [48] preferably cut so that the midpoint of a transverse rib of a key seated therein is offset by a distance from the centerline of any one of the repeated features on the underside of the mounting block which engage with complementary repeated features on the mounting rail [5.] As explained previously, where the pitch of repeated features on the rail is p' then the pitch of underside features on the mount block may also be p' or be a ratio of the pitch p' such as an integer to integer ratio p/k as shown and explained in in FIG. 8.

Here too, for reversibly mountable mount blocks the offset of p/4 between the centerline of a transverse rib of a key [47] seated in its keyseat [48] and the centerlines of repeated underside features of the mount block advantageously intermate with the repeated features of the rail so as to confer the same fine adjustability of scope setback as is described for FIGS. 7 and 8.

One common element in the scope assembly embodiments shown in FIGS. 1, 2, 5*a*, 5*b*, and FIGS. 9 through 12 is that the recoil resisting features and the adjustable setback features such as sets of ribs, grooves or blind holes are all machined subtractions of material from a tubular portion of a scope. Engagement features which are extensions from a scope body are outside the scope of the invention because the resulting shapes usually preclude economical manufacturing by turning of the scope body on a lathe. The engagement features of the invention can all be manufactured after an economical step of removing most of the volume of material by lathe.

Figure 13:
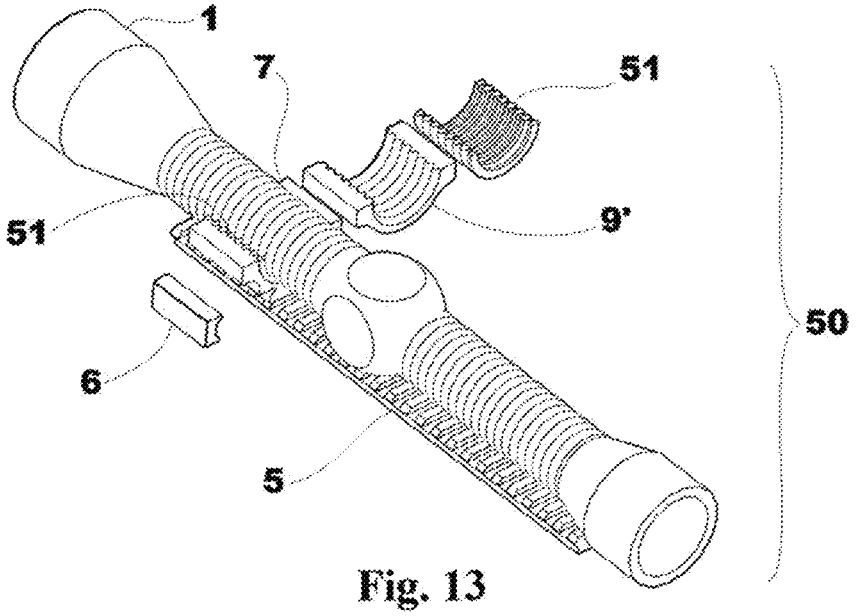
FIG. 13 shows yet another alternative scope assembly and mount in accordance with the invention including a buffer insert.

FIG. 13 shows another alternative embodiment of a scope and mount assembly [50] in accordance with the invention which includes a buffer insert. The mounting rail [5,] the rail clamp [6,] and the ribbed scope [1] are as described in previous figures, but in this embodiment a compliant buffer [51] is interposed between the grooves of the mount block [7] and the scope. The clamp member [9] of this alternative embodiment also has grooves congruent to those in the mount block. The buffer insert cushions the optical components from impulse forces developed by the recoil of the weapon or transmitted shock of semi-automatic or automatic fire.

Figure 14A:
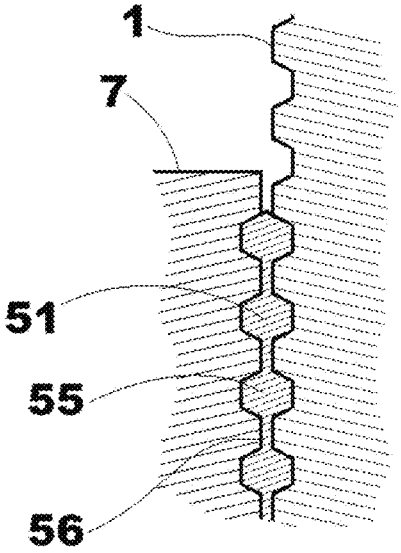
FIG. 14*a* shows a cross section of a buffer insert.

FIG. 14*a* shows a cross section of the buffer insert [51] interposed between the ribs and grooves of a mount block [7] and the ribs and grooves of the scope [1] of the scope assembly. In this embodiment the grooves of the scope align with grooves of the mount block so the buffer comprises a series of thicker ring sections [55] joined by thinner cylindrical membranes [56.] Each such ring section acts like a compression gasket or Belville spring in cushioning the scope from recoil shocks.

Figure 14B:
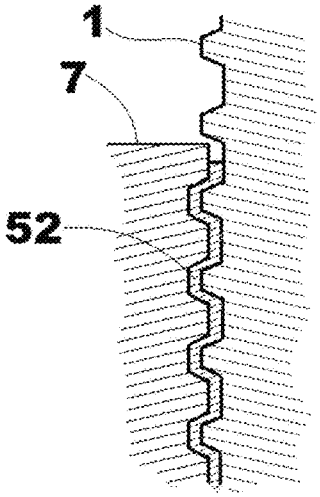
FIG. 14*b* shows a cross section of an alternative buffer insert.

FIG. 14*b* shows a cross section of an alternative buffer insert [52] in which the ribs of the scope [1] align with grooves of the mount block [7] and vice-versa. In this embodiment the buffer insert has a corrugated cross section of more uniform thickness along its length.

Still other embodiments exist within the scope of the invention. For example, some telescopic sights are very long and may be secured to a long rail or an aligned set of intermittent sections of rail secured to a rifle. These sights may require more than two sets of scope mounts to accurately secure. Especially heavy recoil rifles such as the .50BMG and the 20 mm rounds for Vulcan, Solothurn, or Lahti rifles may require larger diameter scopes for target visibility during extreme distance sport shooting or especially precise anti-materiel operations.

Besides firearms, the invention is suitable for all sorts of projectile sports equipment or hunting tools which benefit from optically assisted aiming means mounted thereto. The invention provides effective means to mount telescopic sights on firearms and other projectile tools securely, reliably, economically, and repeatably, and eliminates the variables of the friction joint in a typical scope to ring assemblage. By applying the details of the invention features as described herein and especially the selection of external diameters of the scope body lands, time and cost of implementing the invention and bringing product to market may be reduced.

Also, although "rifle" is mentioned in connection with various sorts of mounting rails commonly affixed to rifles and weapons in general, the invention may be used wherever exceptionally precise alignment of mountable and dismountable parts are required, and especially if the replaceable component comprises a tube which can be anchored at two or more points by means of ribs on the tube. When received into ribs of the mount block the ribs will relocate to the best-fit center of the entire set of engaged ribs. Radial alignment is reestablished by the aligned keyseats and the key.

One suitable application is disassembly and reassembly of tubular components such as the plurality of electron guns, particle beams, and other modular elements of smaller sized (desktop) electron microscope apparatus. These tubular modules attached to a high-vacuum chamber and must be removed and replaced regularly. Since these tools must typically be aligned within tolerances ranging with tens of microns, the ability for precise reassembly of the tools saves time and the expensive labor costs consumed by highly trained technicians and engineers who maintain such equipment.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A scope and mount block assembly, said scope having a body comprising a tubular section defining a longitudinal axis and a plurality of apertures cut into said tubular section, said apertures having centers spaced apart to define a longitudinal pitch p, said mount block having a first portion and a second portion, said first portion including at least one aperture and said second portion comprising means for reversibly mounting to repeated features on a mounting rail, a pin received into an aperture in said tubular section of said scope and received into an aperture in said mount block, and a clamp member, with said scope disposed between said mount block and said clamp member, wherein said repeated features define centerlines spaced apart on a longitudinal pitch p', with an offset between an aperture center and a centerline of one of said repeated features of said mounting rail.

2. The scope and mount block assembly of claim 1, wherein said mounting rail is a Picatinny rail.

3. The scope and mount block assembly of claim 1, wherein said aperture in said mount block is one of a plurality of longitudinally spaced apart apertures in said first portion of said mount block, and said pin is one of a plurality of pins permanently received into said plurality of apertures in said mount block.

4. The scope and mount block assembly of claim 1, wherein said offset between said aperture center and said centerline of one of said repeated features of said mounting rail is p/4.

5. The scope and mount block assembly of claim 1, wherein said pin is one of a plurality of pins permanently received into said plurality of apertures in said tubular section of said scope.

6. The scope and mount block assembly of claim 1, wherein a ratio of p':p of said longitudinal pitches p' and p is 1:1/n, where n is an integer.

7. The scope and mount block assembly of claim 6, wherein said predetermined ratio is selected from the set of ratios consisting of a 1:1 ratio, a 1:1/2 ratio, a 1:1/3 ratio, a 1:1/4 ratio, a 1:1/5 ratio, and a 1:1/10 ratio.

8. The scope and mount block assembly of claim 1, wherein said aperture in said first portion of said mount block defines a first plane of symmetry, and one of said repeated features in second portion of said mount block defines a second plane of symmetry, and said planes of symmetry are longitudinally spaced apart by a predetermined distance.

9. The scope and mount block assembly of claim 8, wherein said predetermined distance is p/4.

10. The scope and mount block assembly of claim 9, wherein said predetermined distance is p'/4.

11. The scope and mount block assembly of claim 1, wherein said offset between said aperture center and said centerline of one of said repeated features of said mounting rail is p'/4.

* * * * *